United States Patent [19]

Johnson et al.

[11] Patent Number: 4,494,355

[45] Date of Patent: Jan. 22, 1985

[54] CASE FEEDING APPARATUS FOR DROP PACKER

[75] Inventors: Lloyd D. Johnson, Portland, Conn.; Jack H. Lewis, Marion, N.Y.

[73] Assignee: Standard-Knapp, Inc., Portland, Conn.

[21] Appl. No.: 359,813

[22] Filed: Mar. 19, 1982

[51] Int. Cl.[3] ..... B65B 57/10

[52] U.S. Cl. ..... 53/69; 53/70; 53/71; 53/247; 53/55

[58] Field of Search ..... 53/69, 67, 70, 71, 55, 53/247, 248

[56] References Cited

U.S. PATENT DOCUMENTS

| | | | |
|---|---|---|---|
| 2,819,576 | 1/1958 | Hendricks et al. | 53/55 X |
| 3,023,555 | 3/1962 | Schesch | 53/71 |
| 3,421,283 | 1/1969 | Schieser | 53/55 |
| 3,884,014 | 5/1975 | Ishida et al. | 53/55 |

*Primary Examiner*—James F. Coan

*Attorney, Agent, or Firm*—McCormick, Paulding & Huber

[57] ABSTRACT

A case feeding apparatus moves open cases onto a lift table where each case is moved upwardly onto the funnel portion of a shifting grid structure so that a slug of articles can be deposited therein. Line pressure advances the cases toward a retractable stop and side belts move the cases individually into an intermittently operated pair of case conveyors capable of handling cases of different size. Arrival of a case at the lift table triggers both the raising and lowering of the lift table and an indexing device controls the case conveyor cycle. The cases have their side flaps folded down by side guides to maintain the case in laterally centered positioned on the lift table and each case conveyor has either pusher lugs or leading lugs to control case position longitudinally.

6 Claims, 3 Drawing Figures

CASE FEEDING APPARATUS FOR DROP PACKER

This invention relates generally to apparatus for loading slugs of articles into upwardly open packing cases, and deals more particularly with an improved case feeding apparatus for use with such a drop packer. The chief aim of the present invention is to provide closer control of the case to be mated with the fixed funnel structure in the drop packer, and to provide for a simplified control system for the case conveyor means and the lift table associated therewith.

In summary the present invention provides for apparatus adapted to feed cases to a point below the funnel structure of a conventional sliding grid drop packer such that a lift table can raise the upwardly open case to mate with the funnel structure and at substantially the same time the grid can be shifted to drop articles into the case. The lift table is adapted to raise the case in response to tripping a limit switch provided in the path of the case to be lifted, and a simple electrical time delay relay control subsequently lowers the table after a predetermined delay. The means for conveying the case onto the lift table comprises a split conveyor having one set of lugs for engaging the trailing edge of the case to be lifted and another set of lugs in the second conveyor for guiding the leading edge of the case. These case conveyors are operated in unison from an indexing means having a start condition and a run condition for intermittently advancing these case conveyors through a predetermined displacement when the table is down. Means is provided for energizing the case indexing means and in its preferred form said indexing means includes a conventional motor and a air pressure controlled clutch and brake unit coupled between the motor and a gear reduction unit such that the case conveyor is precisely moved and smoothly accelerated and decelerated through a predetermined displacement in response to return of the lift table to a down position. The indexing means is returned to its start condition through a simple cam switch after said predetermined case conveyor indexing motion.

Figure 1:
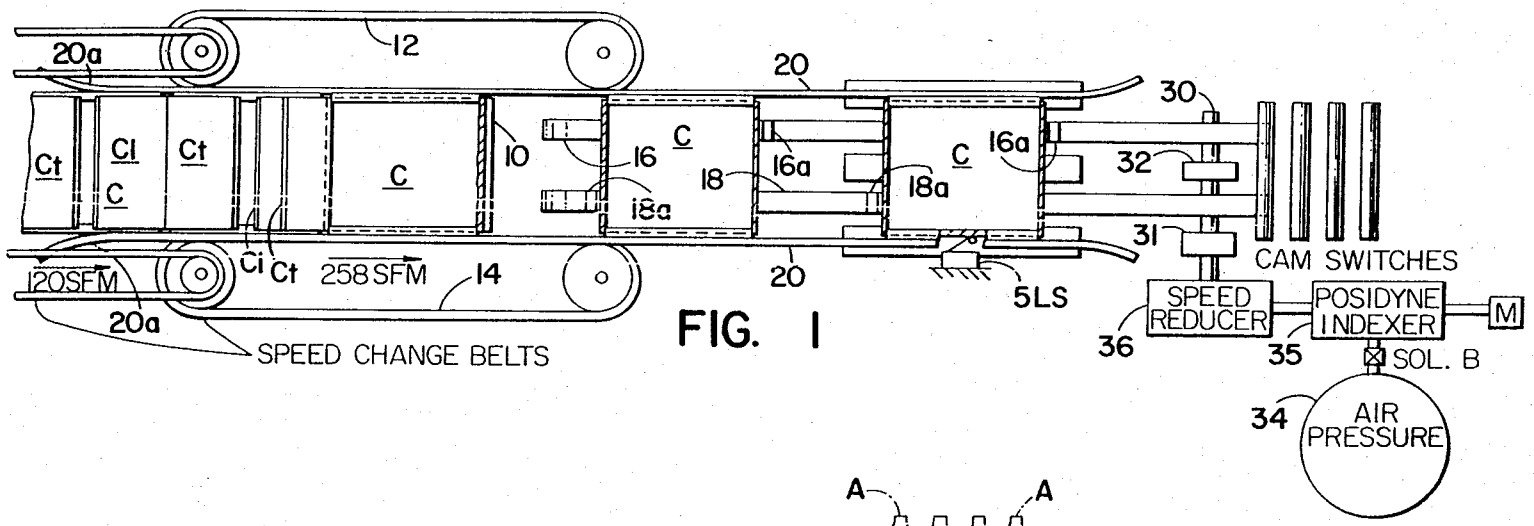
FIG. 1 is a plan view of a case feeding apparatus constructed in accordance with the present invention.

Turning now to the drawings in greater detail, FIG. 1 illustrates a line of upwardly open cases or cartons C, C which are fed by an inteed conveyor (not shown) under line pressure against a retractable stop 10. Side belts 12 and 14 are continuously operated so as to urge these cartons C, C from left to right in FIGS. 1 and 2 with the result that retaction of the stop 10 will cause the cases to move one at a time into case conveyor means 16 and 18 to be described.

Figure 2:
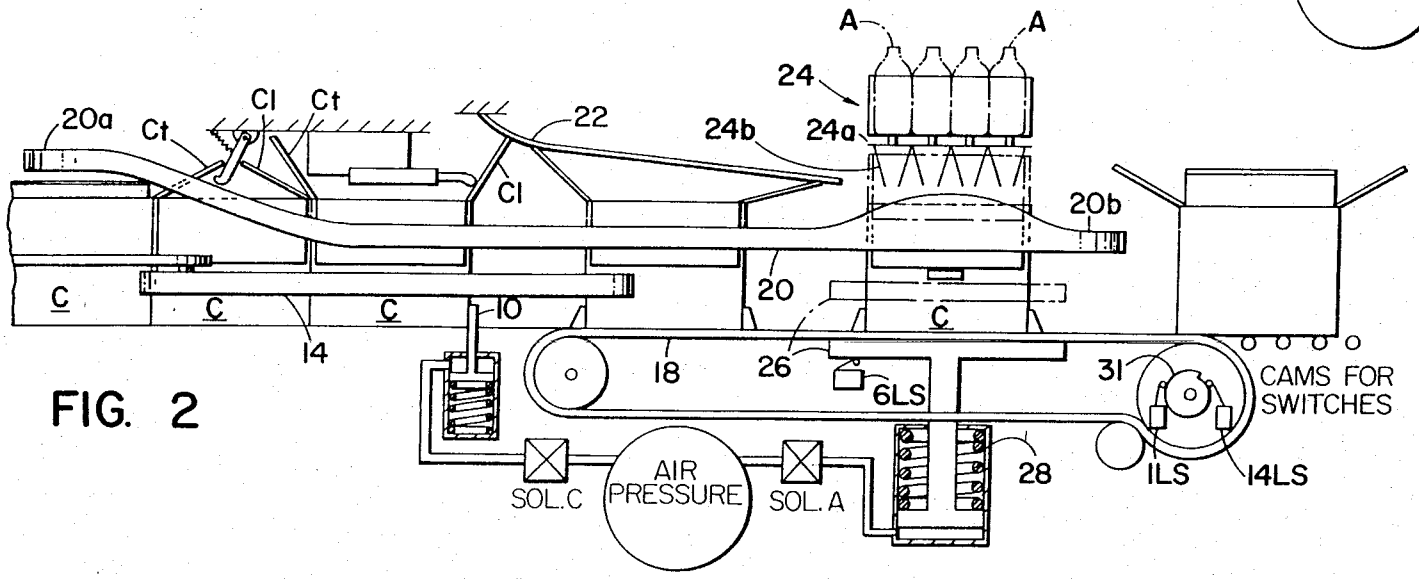
FIG. 2 is a side elevational view of the apparatus depicted in FIG. 1 with a drop packer above the lift table, the table being shown in an alternative position in broken lines.

The cases C, C are of conventional configuration being upwardly open and having top flaps connected to their side panels and to the front and rear case panels as is characteristic of such cases generally. These cases C, C are moved forwardly to a position below the drop packer with the top slide flaps folded downwardly adjacent the side panels in order to locate the case very precisely in a lateral direction, that is perpendicular to the longitudinal direction of the motion of the cartons as depicted in FIGS. 1 and 2. Side guides 20, 20 are provided with portions **20*a* for opening and for holding these top side flaps in the above mentioned configuration and these side flaps remain opened as the carton or case C is lifted at the drop packer station as suggested by the guide plates 20*b* in FIG. 2**.

The trailing top flap Ct is opened by a conventional flap opener as described more completely in prior art U.S. Pat. No. 3,247,646. Leading top flap C1 is preferably opened as shown and described in prior art U.S. Pat. No. 3,852,942. These top flaps Ct and C1 are held at approximately 90 degrees to the front and rear side panels of the case C by fixed flap holding means indicated generally at 22 in FIG. 2. Thus, the case C is fed to a position beneath the drop packing grid structure 24 in a condition such that the top side panels are folded downwardly against the side panels of the case C and such that the leading and trailing top flaps are held out of the downward path of movement for the articles A, A to be packed.

Prior art U.S. Pat. No. 3,561,189 illustrates one possible configuration for such a shifting grid type packer. It is a feature of such a packer that a shifting grid portion thereof **24*a* is operable in timed relationship to the arrival of a case C for loading, the articles A, A being dropped downwardly through fixed funnel structure such as indicated at 24*b* as a result of moving the shifting grid 24*a*** to align its article supporting rails with the lane defining portions of the grid superstructure in order to free the articles A, A for dropping into the packing case.

It is an important feature of the present invention that the signal for shifting grid portion **24*a* coincides with the signal for raising lift table 26, the time taken for the table 26 to move from its solid line position shown in FIG. 2 to its broken line position being approximately equal to the time required to shift the movable grid 24*a* from its position shown to a position which will free the articles A, A allow them to descend into the packing case which has been raised by the lift table 26. A limit switch 5LS is provided on fixed structure in the path of movement of the case C as it arrives at the lift table and preferably switch 5LS is located so as to be engaged by the front panel of the case and this limit switch 5LS will in fact be closed prior to the time that the case C reaches the desired position on the lift table for movement upwardly to mate with the funnel 24*b*. More particularly the precise position for the limit switch 5LS can be empirically determined to account for the delays incident to the operation of related air cylinders, such as that shown at 28 for the lift table 26 and for a similar air cylinder (not shown) for operation of the shifting grid 24*a***.

The apparatus shown and described in this application is intended for use at relatively high rates of speed, and it is important that the case C be precisely located for raising by the lift table 26 and mating with the funnel structure **24*b* described above. This precise control and advancing movement of the case C onto the lift table 26 is accomplished by a pair of laterally spaced case conveyor 16 and 18 which are operated together, but one of which has pusher lugs 18*a*, 18*a* and the other of which case conveyors 16 has leading lugs 16*a* for guiding the front panel of the case C as it is accelerated from a rest position on the case conveyor means to a maximum speed and then decelerated and stopped for upward movement on the lift table 26. These case conveyors 16 and 18 are connected by drive shaft means 30 for movement together, and an angularly adjustable connection 32 is provided between a first sprocket of the drive shaft means connected to conveyor 16 and a second sprocket connected to conveyor 18. As so constructed and arranged the spacing between lugs 18***a* and 16*a* on these conveyors can be conveniently adjusted to accommodate cases of different size. The first sprocket of the drive shaft means 30 is driven from a motor M through an indexer 35 to be described, which indexer is controlled by a solenoid valve B and operates from a source of pneumatic pressure as indicated generally at 34 and in FIG. 1. The output of the indexer operates a speed reducing unit 36 such that one revolution of case conveyor drive shaft 30*a* corresponds to the desired displacement for the case conveyors 16 and 18 necessary to achieve movement of the case from an initial position to a position beneath the fixed grid structure 24. Cam switches 1LS and 14LS are provided so as to be tripped by cam means 32 as shown in FIG. 2 for achieving the necessary control of the indexer and the carton stop 10 referred to previously.

Turning now to a more detailed description of the indexer, this device comprises a conventionally available component, such as the Posidyne clutch/brake unit Model No. 2½ sold by Force Control Industries, Inc. of Hamilton, Ohio. Such a unit operates from a source of air under pressure and has an input port such that air pressure achieves movement of an internally located piston to clamp a clutch disc pack. The clutch pack consists of steel drive discs keyed to an input shaft and alternate bronze face discs splined to the output shaft. During acceleration the torque from input to output shaft is transferred through the viscous shear of a positive oil film between the friction surfaces. As input and output shafts approach synchronous speed the film breaks down, allowing metal to metal contact for 100 percent transfer efficiency. In the braking phase, air pressure provides a force against the piston toward the output end of the unit as air is exhausted from the piston chamber. The piston thrust member clamps the brake disc pack, identical to the clutch pack with the exception of the steel brake disc plates being keyed to the unit housing. Thus, application of air under pressure to the input port provides rapid and cushioned response for both the clutching and braking action. Integral cast impellers on the output shaft provide positive oil circulation internally of the unit through the clutch and brake packs to remove any residual heat of engagement and to lubricate all bearings.

Figure 3:
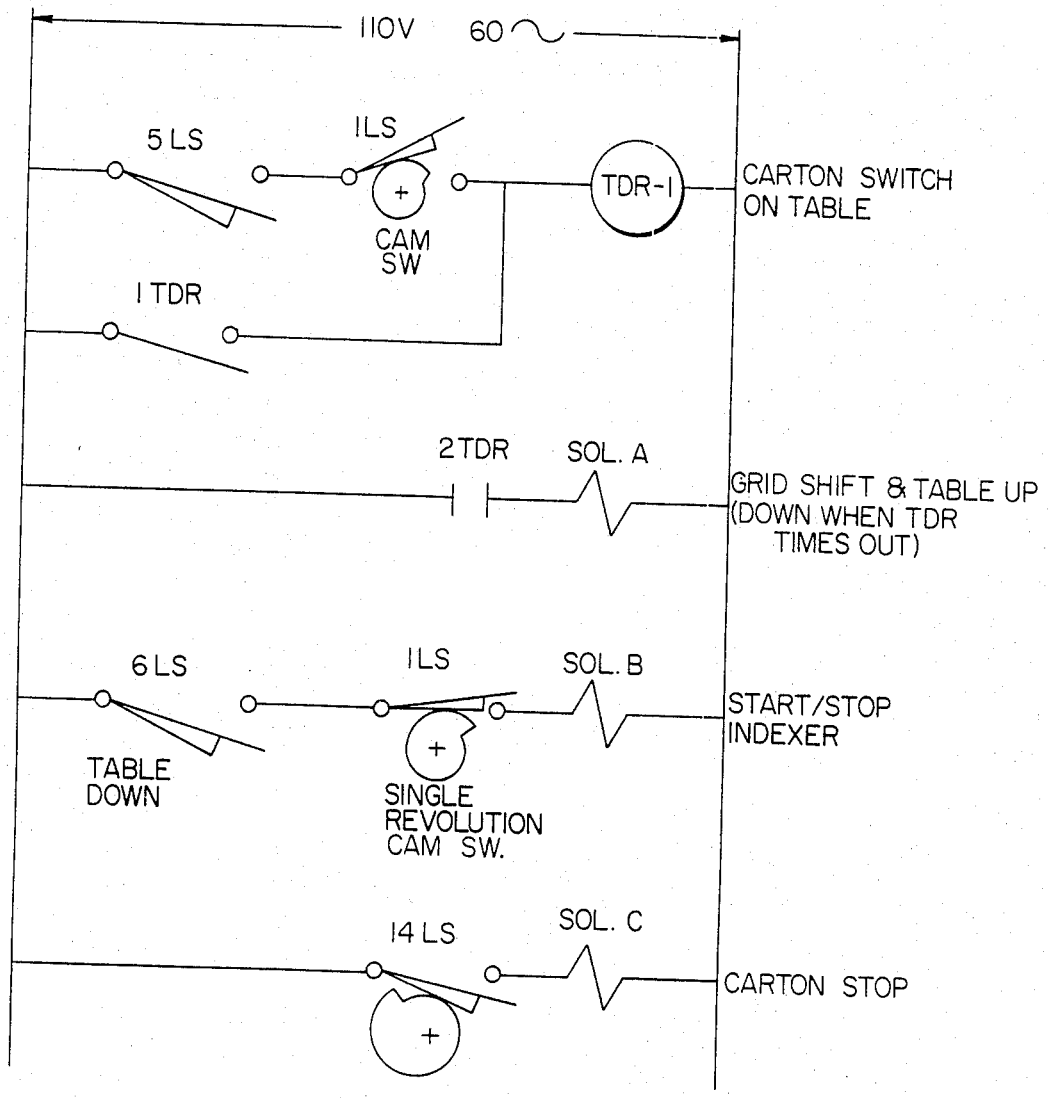
FIG. 3 is a schematic view of a control circuit for operating the case feeding apparatus in conjunction with a conventional shifting grid type packer.

Turning now to a general description of the operation for the case feeding apparatus described above, and referring particularly to FIG. 3 of the drawings, line pressure from the infeed conveyor (not shown) upstream of the side belt conveyors 12 and 14 causes cases C, C to be provided continuously against the stop 10. Limit switch 14LS at the downstream end of case conveyor 18 causes stop 10 to retract at an appropriate time during the cycle of operation feeding a case C onto the case conveyors 16 and 18 and more particularly between the lugs 16*a* and 18*a* as shown. The case conveyor is driven by the indexer through solenoid valve B from the source of pneumatic pressure 34 under the control of two switches, a limit switch 6LS associated with the table 26 being down and limit switch 1LS which is opened as an end of cycle switch to stop the indexer and the infeed conveyors 16 and 18 by deenergizing solenoid B. As mentioned previously limit switch 5LS causes lift table 26 to raise a case C into mating relationship with the fixed funnel structure 24*b* of the drop packer 24. A time delay relay TDR1 is energized as a result of closing limit switch 5LS and contacts 2TDR close upon the energizing of the relay. Timed contacts 1TDR are also closed when relay TDR1 is energized. These contacts 1TDR remain closed until a predetermined delay has timed out, at which point relay TDR1 will be deenergized and table 26 lowered by air cylinder 28 as a result of deenergizing solenoid A through the normally open contacts TDR2. Table down limit switch 6LS assures that the indexer cannot be operated until the table is down. 1LS also serves to prevent the time delay TDR1 from being reactivated until the table has returned to its down position and another case has been advanced by indexer and case conveyor means during a succeeding cycle of operation.

We claim:

1. A case feeding apparatus for use with a drop packer which requires each case to mate with a stationary grid structure so that the articles are guided as they drop into the case, said apparatus comprising:

a lift table movable between up and down positions for raising each case into mating relationship with the fixed grid structure, case conveyor means for moving cases onto the lift table in the down position of said table, indexing means having a start condition and a run condition for intermittently advancing said case conveyor means from a first predetermined position to a second position spaced therefrom when said table is down, sensing means to provide a first signal when a case moves onto said table in said table down position, means responsive to said first signal for moving said lift table up and after a predetermined time delay moving said table down, sensing means to provide a second signal when said table is down, means responsive to said second signal for energizing said indexing means, means returning said indexing means to said start condition, said case conveyor means including at least two laterally spaced conveyors, one of said two conveyors having trailing lugs and the other of said two conveyors having leading lugs for accurately locating the cases therebetween during intermittent case conveyor movement, and shaft means for driving said two conveyors, said shaft means including means for adjustably positioning one of said two conveyors relative to the other to accommodate cases of different longitudinal dimension.

2. The combination of claim 1 wherein said means for energizing said indexing means comprises a motor, and a fluid pressure controlled clutch and brake unit having an input shaft coupled to said motor and an output shaft coupled to a drive shaft for said case conveyor means.

3. The combination of claim 1 further characterized by side guides for holding the top side flaps of the cases in downwardly folded relationship to the case side panels during movement thereof by said case conveyor means.

4. The combination of claim 2 further characterized by side guides for holding the top side flaps of the cases in downwardly folded relationship to the case side panels during movement thereof by said case conveyor means to locate the case in the lateral direction and facilitate mating of the case with the stationery grid structure as the case is raised by said lift table.

5. The combination of claim 2 wherein said means for returning said indexing means to said start condition comprises cam switch means associated with said case conveyor means drive shaft.

6. The combination of claim 5 further characterized by means for urging cases into said case conveyors, a second cam switch associated with said case conveyor means drive shaft, and a retractable stop for interrupting the flow of cases into said case conveyors, said stop being responsive to said cam switch to cause said stop to retract in timed relationship with said indexing means and resultant case conveyor movement.

* * * * *